US008847872B2

(12) United States Patent
Tseng et al.

(10) Patent No.: US 8,847,872 B2
(45) Date of Patent: Sep. 30, 2014

(54) DISPLAY FOR DRIVING A PIXEL CIRCUITRY WITH POSITIVE AND NEGATIVE POLARITIES DURING A FRAME PERIOD AND PIXEL CIRCUITRY

(75) Inventors: Ying-Jhong Tseng, Tainan County (TW); Ming-Cheng Chiu, Tainan County (TW)

(73) Assignee: Himax Display, Inc., Tainan (TW)

( * ) Notice: Subject to any disclaimer, the term of this patent is extended or adjusted under 35 U.S.C. 154(b) by 864 days.

(21) Appl. No.: 12/831,426

(22) Filed: Jul. 7, 2010

(65) Prior Publication Data

US 2012/0007849 A1 Jan. 12, 2012

(51) Int. Cl.
*G09G 3/36* (2006.01)

(52) U.S. Cl.
CPC ..... *G09G 3/3614* (2013.01); *G09G 2310/0291* (2013.01); *G09G 3/3688* (2013.01)
USPC ..... 345/99

(58) Field of Classification Search
USPC ..... 345/99, 213
See application file for complete search history.

(56) References Cited

U.S. PATENT DOCUMENTS

| | | | | |
|---|---|---|---|---|
| 5,966,111 | A * | 10/1999 | Koshoubu et al. | 345/94 |
| 6,628,258 | B1 * | 9/2003 | Nakamura | 345/98 |
| 2002/0186192 | A1 * | 12/2002 | Maruoka et al. | 345/87 |
| 2004/0108988 | A1 * | 6/2004 | Choi | 345/96 |
| 2006/0066765 | A1 * | 3/2006 | Koyama | 349/38 |
| 2009/0295777 | A1 * | 12/2009 | Wang | 345/212 |

* cited by examiner

*Primary Examiner* — Long D Pham
(74) *Attorney, Agent, or Firm* — J.C. Patents

(57) ABSTRACT

A display, a pixel circuitry and an operating method of the pixel circuitry are provided. The display includes a source driver and a pixel circuitry. The source driver converts a first pixel data to a first polarity data voltage and a second polarity data voltage during a first frame period and converts a second pixel data to a third polarity data voltage and a fourth polarity data voltage during a second frame period. The pixel circuitry is coupled to the source driver. The pixel circuitry stores the first polarity data voltage and the second polarity data voltage during the first frame period, displays the first polarity data voltage and the second polarity data voltage during a first sub-period and a second sub-period of the second frame period respectively, and stores the third polarity data voltage and the fourth polarity data voltage during the second frame period.

17 Claims, 13 Drawing Sheets

DISPLAY FOR DRIVING A PIXEL CIRCUITRY WITH POSITIVE AND NEGATIVE POLARITIES DURING A FRAME PERIOD AND PIXEL CIRCUITRY

BACKGROUND OF THE INVENTION

1. Field of the Invention

The invention relates to a display technique. More particularly, the invention relates to a display, a pixel circuitry and an operating method of the pixel circuitry.

2. Description of Related Art

A flat panel display such as a liquid crystal display (LCD), a liquid crystal on silicon (LCOS) display, etc. has advantages of high image quality, small size, light weight, low driving voltage, and low power consumptions, etc., so that it is widely used in consumable communication or electronic products such as video cameras, personal digital assistants (PDAs), mobile phones, notebooks, display screens of desk-top computers and thin digital televisions, etc., and gradually replaces a cathode ray tube (CRT) technique to become a main stream in the display market.

Generally, when the LCOS display displays a frame by using a display frequency of 60 Hz, the frame may have a flicking phenomenon. To reduce the flicking phenomenon of the frame, the display frequency of the frame is increased to 120 Hz, so as to suppress the flicking phenomenon of the frame through a relatively high display frequency. Wherein, according to a method of increasing the display frequency, the same frame data is repeatedly transmitted to a source driver during two frame periods, and the source driver transmits the same frame data of different polarities to a display panel during the two frame periods respectively.

FIG. 1A is a system block diagram illustrating a conventional display. Referring to FIG. 1, a display device 100 includes a timing controller (T-con) 110, a source driver 120, a gate driver 130 and a display panel 140. The T-con 110 outputs a data signal DD to the source driver 120, and the source driver 120 correspondingly outputs a data voltage to the display panel 140, wherein the data voltage may have a positive polarity or a negative polarity. Now, the gate driver 130 is controlled by the T-con 110 to activate a pixel circuitry PX of the display panel 140 to receive the data voltage, and then drives the pixel circuitry PX of the display panel 140 to display according to the stored data voltage.

FIG. 1B is a driving timing diagram of the data signal DD and the pixel circuitry PX of FIG. 1A. During a data writing period dw1 of a frame period fp1, the data signal DD delivers a frame data F1, wherein the frame data F1 contains a first pixel data D1. Now, the source driver 120 outputs a positive polarity data voltage D1+ to the pixel circuitry PX of the display panel 140 according to the first pixel data D1. During a vertical blanking period vb1 of the frame period fp1 and a data writing period dw2 of a frame period fp2, the pixel circuitry PX is controlled by the gate driver 130 to display according to the positive polarity data voltage D1+.

During the data writing period dw2 of the frame period fp2, the data signal DD also delivers the frame data F1, and now the source driver 120 outputs a negative polarity data voltage D1− to the pixel circuitry PX of the display panel 140 according to the first pixel data D1. During a vertical blanking period vb2 of the frame period fp2 and a data writing period dw3 of a frame period fp3, the pixel circuitry PX is controlled by the gate driver 130 to display according to the negative polarity data voltage D1−.

According to the above descriptions, the source driver 120 receives the frame data F1 twice, so as to respectively output the positive polarity data voltage (for example, D1+) and the negative polarity data voltage (for example, D1−) during different frame periods (for example, the frame periods fp1 and fp2). Similarly, if the display device 100 is about to display a frame data F2 containing a second pixel data D2, the data signal DD delivers the frame data F2 twice to the source driver 120, so as to respectively generate a positive polarity data voltage (for example, D2+) and a negative polarity data voltage (for example, D2−). Moreover, the pixel circuitry PX is also controlled by the gate driver 130 to display according to the positive polarity data voltage (for example, D2+) and the negative polarity data voltage (for example, D2−) during different periods.

Since the pixel circuitry PX of the display device 100 can only store one data voltage during one frame period, the positive polarity data voltage and the negative polarity data voltage corresponding to the same pixel data are respectively transmitted to the pixel circuitry PX during two neighbouring frame periods. Therefore, while the display device 100 increases the display frequency of the frame, a data transmission rate of the source driver 120 is accordingly increased, so that a power consumption of the source driver 120 is correspondingly increased. Moreover, if the data transmission rate is excessively high, the data signal DD received by the source driver 120 can be distorted. Now, pins of the source driver 120 used for receiving the data signal DD can be increased to reduce the data transmission rate. However, increasing of the pins of the source driver 120 used for receiving the data signal DD not only increases a hardware cost of the display device 100, a circuit structure of the source driver 120 is also required to be correspondingly modified, so that a cost for circuit design is increased.

SUMMARY

The invention is directed to a display, a pixel circuitry and an operating method thereof, in which a source driver generates a first polarity data voltage and a second polarity data voltage according to a pixel data, and the pixel circuitry can receive and stores the first polarity data voltage and the second polarity data voltage at a same time.

The invention provides a display including a source driver and a pixel circuitry. The source driver converts a first pixel data to a first polarity data voltage and a second polarity data voltage during a first frame period and converts a second pixel data to a third polarity data voltage and a fourth polarity data voltage during a second frame period. The pixel circuitry is coupled to the source driver. The pixel circuitry stores the first polarity data voltage and the second polarity data voltage during the first frame period, displays the first polarity data voltage and the second polarity data voltage during a first sub-period and a second sub-period of the second frame period respectively, and stores the third polarity data voltage and the fourth polarity data voltage during the second frame period.

The invention provides a pixel circuitry of a display. The pixel circuitry includes a display unit and a storage unit. The storage unit includes a first writing switch, a second writing switch, a third writing switch, a first memory unit, a second memory unit, a third memory unit and a switching unit. A first end of the first writing switch is connected to the source driver. The first memory unit is coupled to a second end of the first writing switch. A first end of second writing switch is connected to the source driver. The second memory unit is coupled to a second end of the second writing switch. A first end of the third writing switch is coupled to the source driver. The third memory unit is coupled to a second end of the third writing switch. A input terminal of the switching unit is coupled to the first memory unit, a second input terminal of the switching unit is coupled to the second memory unit, a third input terminal of the switching unit is coupled to the third memory unit, and an output terminal of the switching unit is coupled to the display unit.

The invention also provides an operating method of a pixel circuitry. The operating method includes following steps. During a first frame period, a first polarity data voltage and a second polarity data voltage of a first pixel data are stored. During a first sub-period and a second sub-period of a second frame period, the first polarity data voltage and the second polarity data voltage are respectively output to a display unit. During the second frame period, a third polarity data voltage and a fourth polarity data voltage of a second pixel data are stored.

According to the above descriptions, in the display, the pixel circuitry and the operating method of the pixel circuitry of the invention, the pixel circuitry simultaneously stores two data voltages having different polarities that correspond to the same pixel data during one frame period, and sequentially outputs two data voltages having different polarities that are stored during a pervious frame period. In this way, a data transmission rate of the source driver can be reduced.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
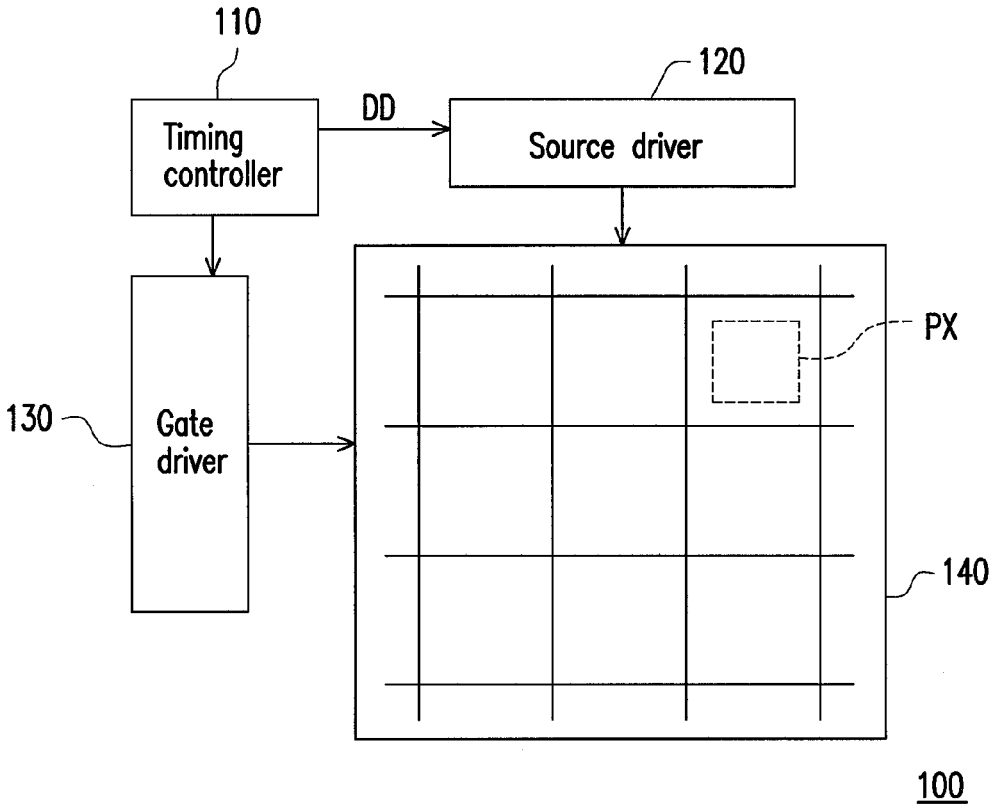
FIG. 1A (Related Art)
FIG. 1A is a system block diagram illustrating a conventional display.
Figure 1B:
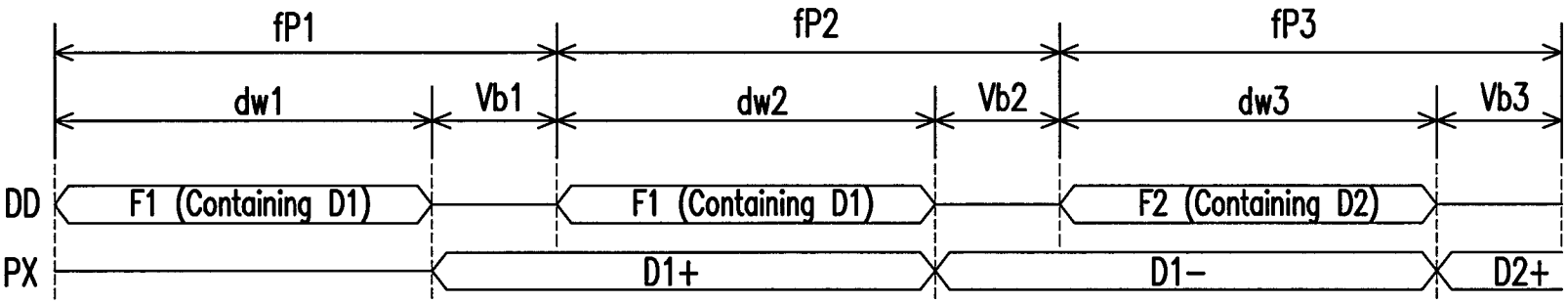
FIG. 1B (Related Art)
FIG. 1B is a driving timing diagram of a data signal DD and a pixel circuitry PX of FIG. 1A.

Reference will now be made in detail to the present preferred embodiments of the invention, examples of which are illustrated in the accompanying drawings. Wherever possible, the same reference numbers are used in the drawings and the description to refer to the same or like parts.

Figure 2:
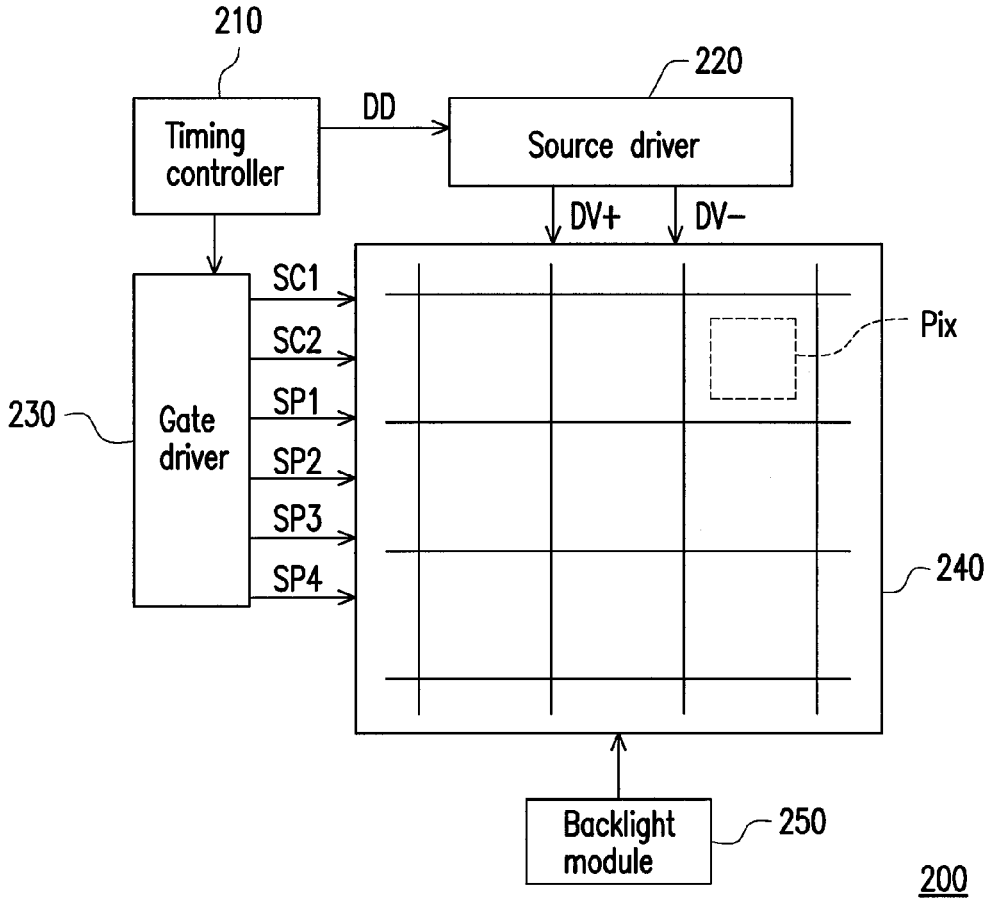
FIG. 2 is a system block diagram illustrating a display according to an embodiment of the invention.

FIG. 2 is a system block diagram illustrating a display according to an embodiment of the invention. Referring to FIG. 2, the display 200 includes a timing controller (T-con) 210, a source driver 220, a gate driver 230 and a display panel 240. The gate driver 230 is controlled by the T-con 210, and outputs a first scan signal SC1 or a second scan signal SC2 to drive a pixel circuitry Pix in the display panel 240. Wherein, the first scan signals SC1 and the second scan signals SC2 are output during different frame periods, and a number of the first scan signals SC1 and the second scan signals SC2 is determined according to a number of rows of an array formed by the pixel circuitries Pix in the display panel 240.

The source driver 220 receives a data signal DD from the T-con 210, and outputs a positive polarity data signal DV+ and a negative polarity data signal DV− to the pixel circuitry Pix in the display panel 240 that is driven by the gate driver 230 during a frame period, wherein the positive polarity data signal DV+ and the negative polarity data signal DV− correspond to a same frame, and a number of the positive polarity data signals DV+ and the negative polarity data signals DV− is determined according to a number of columns of an array formed by the pixel circuitries Pix in the display panel 240.

After the source driver 220 provides the positive polarity data signal DV+ and the negative polarity data signal DV− to all of the pixel circuitries Pix in the display panel 240, the gate driver 230 outputs a first display signal SP1, a second display signal SP2, a third display signal SP3 or a fourth display signal SP4 to drive the pixel circuitries Pix to display a frame, wherein the first display signal SP1, the second display signal SP2, the third display signal SP3 or the fourth display signal SP4 are not overlapped on timing.

Moreover, if a display device in the pixel circuitry Pix is a none light-emitting device, the display 200 further includes a backlight module 250, which is used for providing a planar light source required by the display panel 240, so that the display panel 240 can display images for a user to view.

Figure 3A:
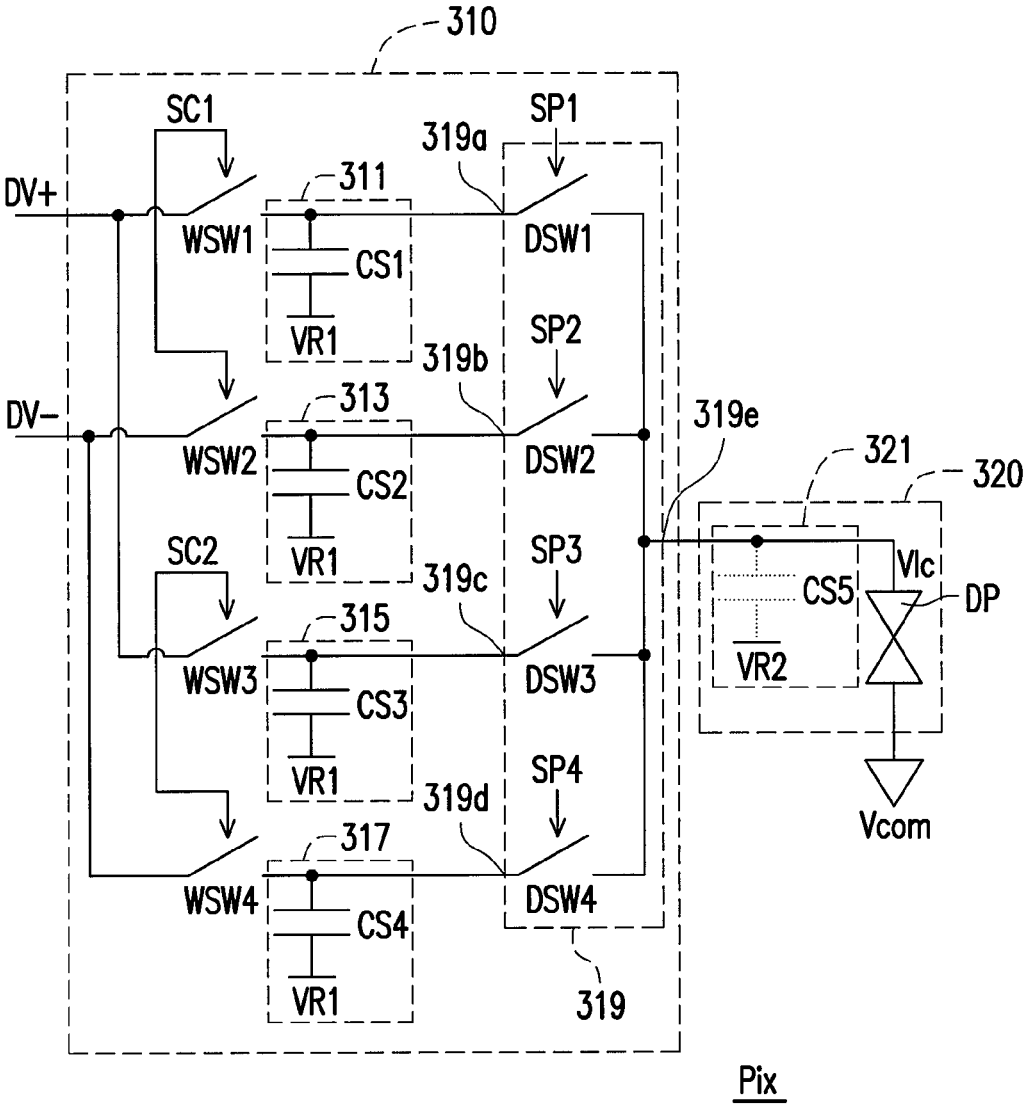
FIG. 3A is a circuit schematic diagram illustrating a pixel circuitry Pix of FIG. 2 according to a first embodiment of the invention.

FIG. 3A is a circuit schematic diagram illustrating the pixel circuitry Pix of FIG. 2 according to a first embodiment of the invention. Referring to FIG. 3A, the pixel circuitry Pix includes a storage unit 310 and a display unit 320. The storage unit 310 includes a first writing switch WSW1, a second writing switch WSW2, a third writing switch WSW3, a fourth writing switch WSW4, a first memory unit 311, a second memory unit 313, a third memory unit 315, a fourth memory unit 317 and a switching unit 319.

Referring to FIG. 2 and FIG. 3A, a first end of the first writing switch WSW1 is connected to the source driver 220 for receiving a positive polarity data voltage delivered by the positive polarity data signal DV+, and the first writing switch WSW1 is controlled by the first scan signal SC1. A first terminal of the first memory unit 311 is coupled to a second end of the first writing switch WSW1, and a second terminal of the first memory unit 311 receives a first reference voltage VR1. Wherein, the first memory unit 311 stores the positive polarity data voltage through the first writing switch WSW1. A first input terminal 319*a* of the switching unit 319 is coupled to the first memory unit 311. The switching unit 319 outputs the positive polarity data voltage stored in the first memory unit 311 through its output terminal 319*e* according to the first display signal SP1.

A first end of the second writing switch WSW2 is connected to the source driver 220 for receiving a negative polarity data voltage delivered by the negative polarity data signal DV−, and the second writing switch WSW2 is controlled by the first scan signal SC1. A first terminal of the second memory unit 313 is coupled to a second end of the second writing switch WSW2, and a second terminal of the second memory unit 313 receives the first reference voltage VR1. Wherein, the second memory unit 313 stores the negative polarity data voltage through the second writing switch WSW2. A second input terminal 319*b* of the switching unit 319 is coupled to the second memory unit 313. The switching unit 319 outputs the negative polarity data voltage stored in the second memory unit 313 through its output terminal 319*e* according to the second display signal SP2.

A first end of the third writing switch WSW3 is connected to the source driver 220 for receiving the positive polarity data voltage delivered by the positive polarity data signal DV+, and the third writing switch WSW3 is controlled by the second scan signal SC2. A first terminal of the third memory unit 315 is coupled to a second end of the third writing switch WSW3, and a second terminal of the third memory unit 315 receives the first reference voltage VR1. Wherein, the third memory unit 315 stores the positive polarity data voltage through the third writing switch WSW3. A third input terminal 319*c* of the switching unit 319 is coupled to the third memory unit 315. The switching unit 319 outputs the positive polarity data voltage stored in the third memory unit 315 through its output terminal 319*e* according to the third display signal SP3.

A first end of the fourth writing switch WSW4 is connected to the source driver 220 for receiving the negative polarity data voltage delivered by the negative polarity data signal DV−, and the fourth writing switch WSW4 is controlled by the second scan signal SC2. A first terminal of the fourth memory unit 317 is coupled to a second end of the fourth writing switch WSW4, and a second terminal of the fourth memory unit 317 receives the first reference voltage VR1. Wherein, the fourth memory unit 317 stores the negative polarity data voltage through the fourth writing switch WSW4. A fourth input terminal 319*d* of the switching unit 319 is coupled to the fourth memory unit 317. The switching unit 319 outputs the negative polarity data voltage stored in the fourth memory unit 317 through its output terminal 319*e* according to the fourth display signal SP4.

The switching unit 319 includes a first display switch DSW1, a second display switch DSW2, a third display switch DSW3 and a fourth display switch DSW4. A first end of the first display switch DSW1 serves as the first input terminal 319*a* of the switching unit 319, a second end of the first display switch DSW1 is coupled to the output terminal 319*e* of the switching unit 319, and the first display switch DSW1 is controlled by the first display signal SP1. A first end of the second display switch DSW2 serves as the second input terminal 319*b* of the switching unit 319, a second end of the second display switch DSW2 is coupled to the output terminal 319*e* of the switching unit 319, and the second display switch DSW2 is controlled by the second display signal SP2.

A first end of the third display switch DSW3 serves as the third input terminal 319*c* of the switching unit 319, a second end of the third display switch DSW3 is coupled to the output terminal 319*e* of the switching unit 319, and the third display switch DSW3 is controlled by the third display signal SP3. A first end of the fourth display switch DSW4 serves as the fourth input terminal 319*d* of the switching unit 319, a second end of the fourth display switch DSW4 is coupled to the output terminal 319*e* of the switching unit 319, and the fourth display switch DSW4 is controlled by the fourth display signal SP4.

The display unit 320 includes a display element DP. One end of the display element DP is coupled to the output terminal 319*e* of the switching unit 319, so as to receive the positive polarity data voltage stored in the first memory unit 311, the negative polarity data voltage stored in the second memory unit 313, the positive polarity data voltage stored in the third memory unit 315 or the negative polarity data voltage stored in the fourth memory unit 317 through the switching unit 319.

Moreover, the display unit 320 can further include a display memory unit 321. A first terminal of the display memory unit 321 is coupled to the output terminal 319*e* of the switching unit 319, and a second terminal of the display memory unit 321 receives a second reference voltage VR2. In the present embodiment, the display element DP is, for example, a liquid crystal capacitor DP. The liquid crystal capacitor DP is driven by a potential difference between a pixel voltage Vlc and a common voltage Vcom, and an angle of the liquid crystal in the liquid crystal capacitor DP is varied according to the potential difference.

Figure 3B:
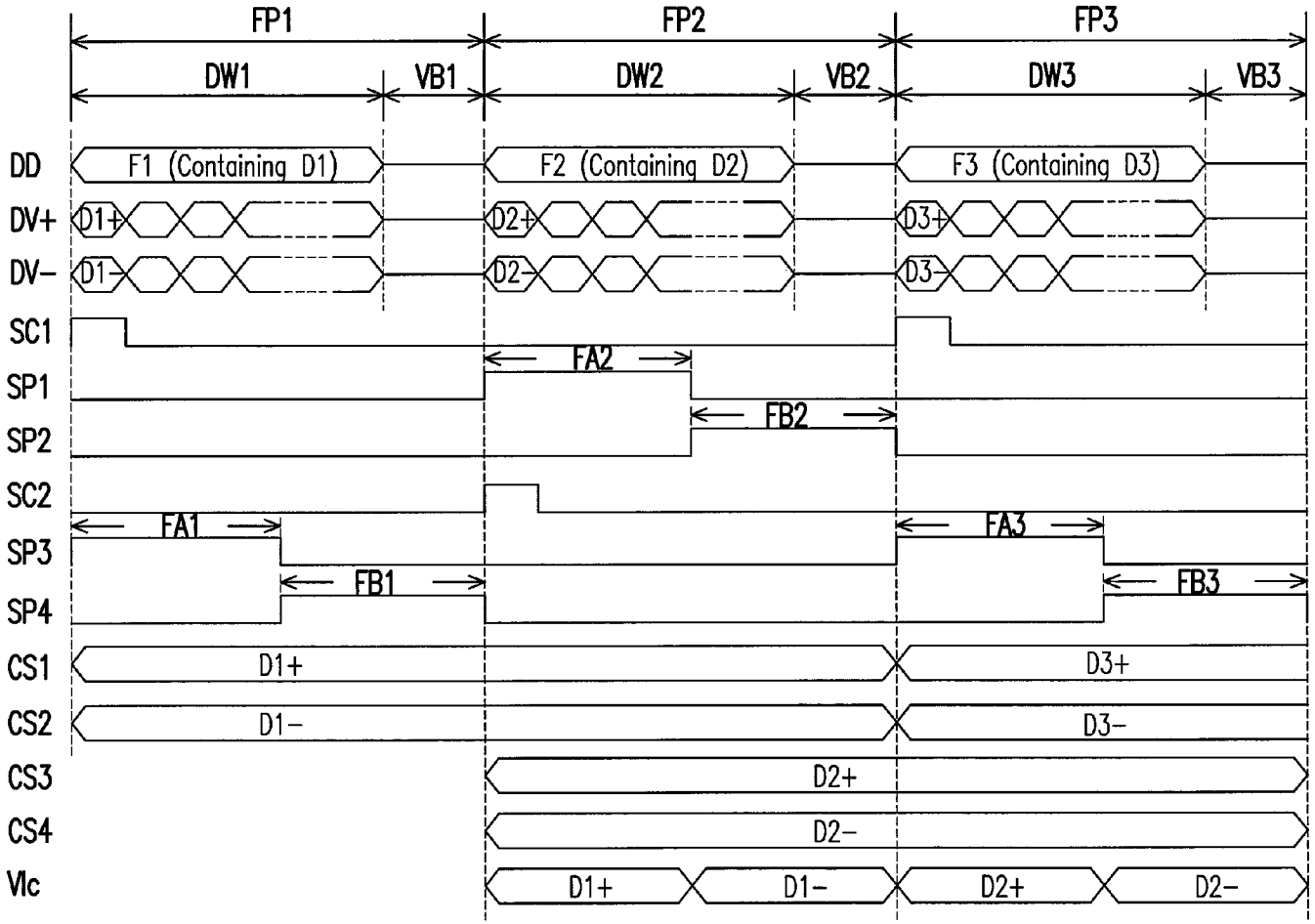
FIG. 3B is a driving timing diagram of a display 200 according to an embodiment of the invention.

FIG. 3B is a driving timing diagram of the display 200 according to an embodiment of the invention. Referring to FIG. 2, FIG. 3A and FIG. 3B, in the present embodiment, each frame period (for example, FP1, FP2 or FP3) includes a data writing period (for example, DW1, DW2 or DW3) and a vertical blanking period (for example, VB1, VB2 or VB3). During the frame period FP1, the data signal DD delivers a frame data F1 containing a first pixel data D1. When the source driver 220 receives the first pixel data D1, the source driver 220 converts the first pixel data D1 to a positive polarity data voltage D1+ and a negative polarity data voltage D1−. Now, the positive polarity data signal DV+ delivers the positive polarity data voltage D1+, and the negative polarity data signal DV− delivers the negative polarity data voltage D1−.

During the frame period FP1, the first scan signal SC1 is switched to a high level during the data writing period DW1, and the second scan signal SC2 is in a low level. In fact, a time for the first scan signal SC1 being in the high level is inversely proportional to a number of the first scan signals SC1, and the time for the first scan signals SC1 being in the high level is not overlapped. Moreover, since the second scan signal SC2 is in the low level, the third writing switch WSW3 and the fourth writing switch WSW4 are in a turn-off state. When the first scan signal SC1 is in the high level, the first writing switch WSW1 and the second writing switch WSW2 are in a turn-on state.

Assuming when the first scan signal SC1 is in the high level, the positive polarity data signal DV+ and the negative polarity data signal DV− respectively deliver the positive polarity data voltage D1+ and the negative polarity data voltage D1−, a first capacitor CS1 in the first memory unit 311 receives the positive polarity data voltage D1+ through the first writing switch WSW1, so that the first capacitor CS1 now stores charges, and therefore a cross-voltage of the first capacitor CS1 is about the positive polarity data voltage D1+. In addition, a second capacitor CS2 in the second memory unit 313 receives the negative polarity data voltage D1− through the second writing switch WSW2, so that the second capacitor CS2 now stores charges, and therefore a cross-voltage of the second capacitor CS2 is about the negative polarity data voltage D1−. In this way, the pixel circuitry Pix can simultaneously store the positive polarity data voltage D1+ and the negative polarity data voltage D1− during one frame period, so as to reduce a data transmission rate of the source driver 120.

Moreover, during the frame period FP1, the first display signal SP1 and the second display signal SP2 are in the low level, so that the first display switch DSW1 and the second display switch DSW2 of the switching unit 319 are in a turn-off state. Moreover, during a front half period FA1 of the frame period FP1, the third display signal SP3 is in the high level, so that a voltage stored by a third capacitor CS3 of the third memory unit 315 is transmitted to the liquid crystal capacitor DP and a fifth capacitor CS5 of the display memory unit 321 through the third display switch DSW3. Now, a potential difference required for driving the liquid crystal capacitor DP is continually provided by the third capacitor CS3, the fifth capacitor CS5 and the liquid crystal capacitor DP itself.

During a back half period FB1 of the frame period FP1, the fourth display signal SP4 is in the high level, so that a voltage stored by a fourth capacitor CS4 of the fourth memory unit 317 is transmitted to the liquid crystal capacitor DP and the fifth capacitor CS5 of the display memory unit 321 through the fourth display switch DSW4. Now, a potential difference required for driving the liquid crystal capacitor DP is continually provided by the fourth capacitor CS4, the fifth capacitor CS5 and the liquid crystal capacitor DP itself. In the present embodiment, the voltages stored by the third capacitor CS3 and the fourth capacitor CS4 during the frame period FP1 are not data voltages used for displaying, so that an influence for turning on the third display switch DSW3 and the fourth display switch DSW4 can be neglected. In other embodiments, the display memory unit 321 can be omitted according to a design requirement, and the third capacitor CS3 or the fourth capacitor CS4 and the liquid crystal capacitor DP are used to reserve the data voltage.

During the frame period FP2, the data signal DD delivers a frame data F2 containing a second pixel data D2. When the source driver 220 receives the second pixel data D2, the source driver 220 converts the second pixel data D2 to a positive polarity data voltage D2+ and a negative polarity data voltage D2−. Now, the positive polarity data signal DV+ delivers the positive polarity data voltage D2+, and the negative polarity data signal DV− delivers the negative polarity data voltage D2−.

During the frame period FP2, the first scan signal SC1 is in the low level, and the second scan signal SC2 is switched to the high level during the data writing period DW2. In fact, a time for the second scan signal SC2 being in the high level is inversely proportional to a number of the second scan signals SC2, and the time for the second scan signals SC2 being in the high level is not overlapped. During the frame period FP2, since the first scan signal SC1 is in the low level, the first writing switch WSW1 and the second writing switch WSW2 are in the turn-off state. When the second scan signal SC2 is in the high level, the third writing switch WSW3 and the fourth writing switch WSW4 are in the turn-on state.

Assuming when the second scan signal SC2 is in the high level, the positive polarity data signal DV+ and the negative polarity data signal DV− respectively deliver the positive polarity data voltage D2+ and the negative polarity data voltage D2−, the third capacitor CS3 receives the positive polarity data voltage D2+ through the third writing switch WSW3, so that the third capacitor CS3 now stores charges, and therefore a cross-voltage of the third capacitor CS3 is about the positive polarity data voltage D2+. In addition, the fourth capacitor CS4 receives the negative polarity data voltage D2− through the fourth writing switch WSW4, so that the fourth capacitor CS4 now stores charges, and therefore a cross-voltage of the fourth capacitor CS4 is about the negative polarity data voltage D2−.

Moreover, during the frame period FP2, the third display signal SP3 and the fourth display signal SP4 are in the low level, so that the third display switch DSW3 and the fourth display switch DSW4 are in the turn-off state. Moreover, during a front half period FA2 of the frame period FP2, the first display signal SP1 is in the high level, so that the positive polarity data voltage D1+ stored by the first capacitor CS1 is transmitted to the liquid crystal capacitor DP and the fifth capacitor CS5 through the first display switch DSW1. Now, the pixel voltage Vlc is approximately equal to the positive polarity data voltage D1+, and a potential difference required for driving the liquid crystal capacitor DP is continually provided by the first capacitor CS1, the fifth capacitor CS5 and the liquid crystal capacitor DP itself.

During a back half period FB2 of the frame period FP2, the second display signal SP2 is in the high level, so that the negative polarity data voltage D1− stored by the second capacitor CS2 is transmitted to the liquid crystal capacitor DP and the fifth capacitor CS5 through the second display switch DSW2. Now, the pixel voltage Vlc is approximately equal to the negative polarity data voltage D1−, and a potential difference required for driving the liquid crystal capacitor DP is continually provided by the second capacitor CS2, the fifth capacitor CS5 and the liquid crystal capacitor DP itself. In other embodiments, the display memory unit 321 can be omitted according to a design requirement, and the first capacitor CS1 or the second capacitor CS2 and the liquid crystal capacitor DP are used to reserve the data voltage.

During the frame period FP3, the data signal DD delivers a frame data F3 containing a third pixel data D3. When the source driver 220 receives the third pixel data D3, the source driver 220 converts the third pixel data D3 to a positive polarity data voltage D3+ and a negative polarity data voltage D3−. Now, the positive polarity data signal DV+ delivers the positive polarity data voltage D3+, and the negative polarity data signal DV− delivers the negative polarity data voltage D3−.

During the frame period FP3, operations of the first writing switch WSW1, the second writing switch WSW2, the third writing switch WSW3, the fourth writing switch WSW4, the first display switch DSW1, the second display switch DSW2, the third display switch DSW3 and the fourth display switch DSW4 are similar to the operations of these switches during the frame period FP1. Now, the first capacitor CS1 receives the positive polarity data voltage D3+ through the first writing switch WSW1, and the second capacitor CS2 receives the negative polarity data voltage D3− through the second writing switch WSW2. Moreover, the positive polarity data voltage D2+ stored by the third capacitor CS3 is transmitted to the liquid crystal capacitor DP and the fifth capacitor CS5 through the third display switch DSW3 during a front half period FA3 of the frame period FP3, so that the pixel voltage Vlc is approximately equal to the positive polarity data voltage D2+. The negative polarity data voltage D2− stored by the fourth capacitor CS4 is transmitted to the liquid crystal capacitor DP and the fifth capacitor CS5 through the fourth display switch DSW4 during a back half period FB3 of the frame period FP3, so that the pixel voltage Vlc is approximately equal to the negative polarity data voltage D2−.

According to the above descriptions, by controlling conducting states of the first writing switch WSW1, the second writing switch WSW2, the third writing switch WSW3, the fourth writing switch WSW4, the first display switch DSW1, the second display switch DSW2, the third display switch DSW3 and the fourth display switch DSW4, the first capacitor CS1 and the third capacitor CS3 can alternately store the positive polarity data voltage (for example, D1+, D2+ or D3+) corresponding to different pixel data during different frame periods, and alternately output the stored positive polarity data voltage (for example, D1+, D2+ or D3+). Moreover, the second capacitor CS2 and the fourth capacitor CS4 can alternately store the negative polarity data voltage (for example, D1−, D2− or D3−) corresponding to different pixel data during different frame periods, and alternately output the stored negative polarity data voltage (for example, D1−, D2− or D3−).

Figure 4:
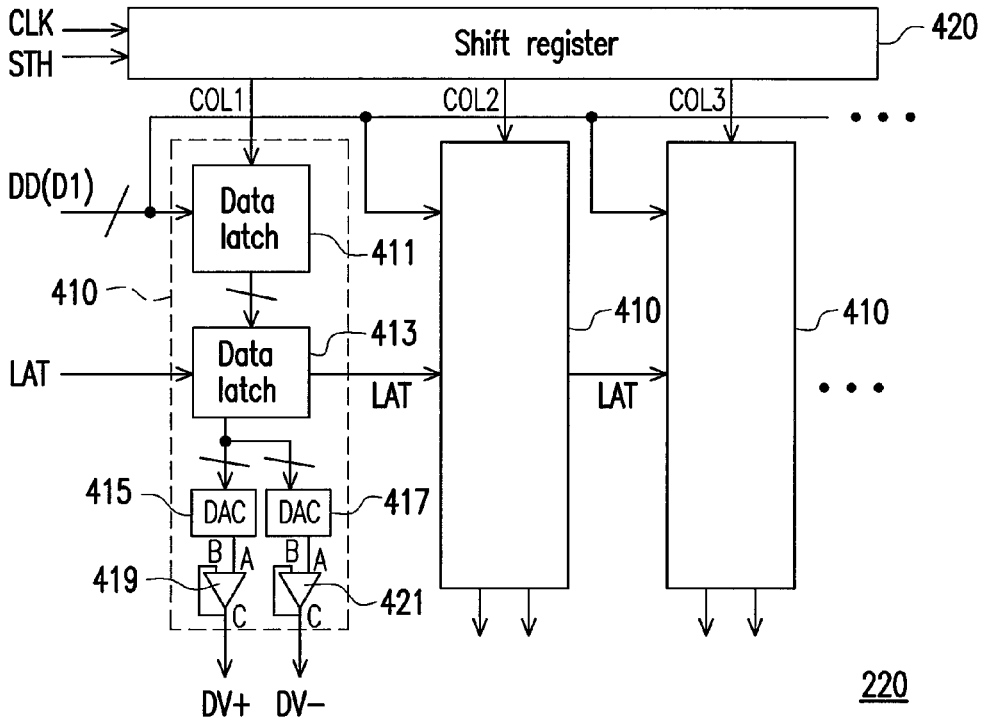
FIG. 4 is a circuit schematic diagram illustrating a source driver 220 of FIG. 2.

FIG. 4 is a circuit schematic diagram illustrating the source driver 220 of FIG. 2. Referring to FIG. 2 and FIG. 4, in the present embodiment, the source driver 220 includes a shift register 420 and a plurality of data channels 410, wherein a number of the data channels 410 is proportional to a number of columns of an array formed by the pixel circuitries Pix in the display panel 240. The shift register 420 sequentially outputs a plurality of control signals (e.g. control signals COL1, COL2 and COL3) according to a start signal STH and a clock signal CLK. The data channels 410 simultaneously receive the data signal DD and respectively receive one of the control signals (e.g. the control signal COL1). Circuit structures of the data channels 410 are similar, and one of the data channels 410 is taken as an example for description.

The data channel 410 includes a first data latch 411, a second data latch 413, a first digital-to-analog converter (DAC) 415 and a second DAC 417. A data input terminal of the first data latch 411 receives the pixel data (for example, D1) delivered by the data signal DD, and a trigger terminal of the first data latch 411 receives the control signal COL1. A data input terminal of the second data latch 413 is coupled to a data output terminal of the first data latch 411, and a trigger terminal of the second data latch 413 receives a latch signal LAT outputted from the T-con 210. Input terminals of the first DAC 415 and the second DAC 417 are coupled to a data output terminal of the second data latch 413.

The first data latch 411 determines whether or not to latch the pixel data (for example, D1) delivered by the data signal DD according to the control signal COL1. The first data latch 411 outputs the latched pixel data D1 to the second data latch 413. The second data latch 413 determines whether or not to latch the received pixel data (for example, D1) according to the latch signal LAT. The second data latch 413 outputs the latched pixel data D1 to the first and the second DACs 415 and 417. The first DAC 415 outputs the positive polarity data signal DV+ according to the received pixel data (for example, D1), the second DAC 417 outputs the negative polarity data signal DV− according to the received pixel data (for example, D1).

In the present embodiment, the data channel 410 further includes amplifiers 419 and 421. An input terminal A of the amplifier 419 is coupled to an output terminal of the first DAC 415, and input terminal B of the amplifier 419 is coupled to an output terminal C of the amplifier 419, and the output terminal C outputs the positive polarity data signal DV+, wherein a circuit structure of the amplifier 419 can be regarded as a voltage follower. A circuit structure of the amplifier 421 is similar to that of the amplifier 419, and an input terminal A of the amplifier 421 is coupled to an output terminal of the second DAC 417, and an output terminal C of the amplifier 421 outputs the negative polarity data signal DV−.

Figure 5:
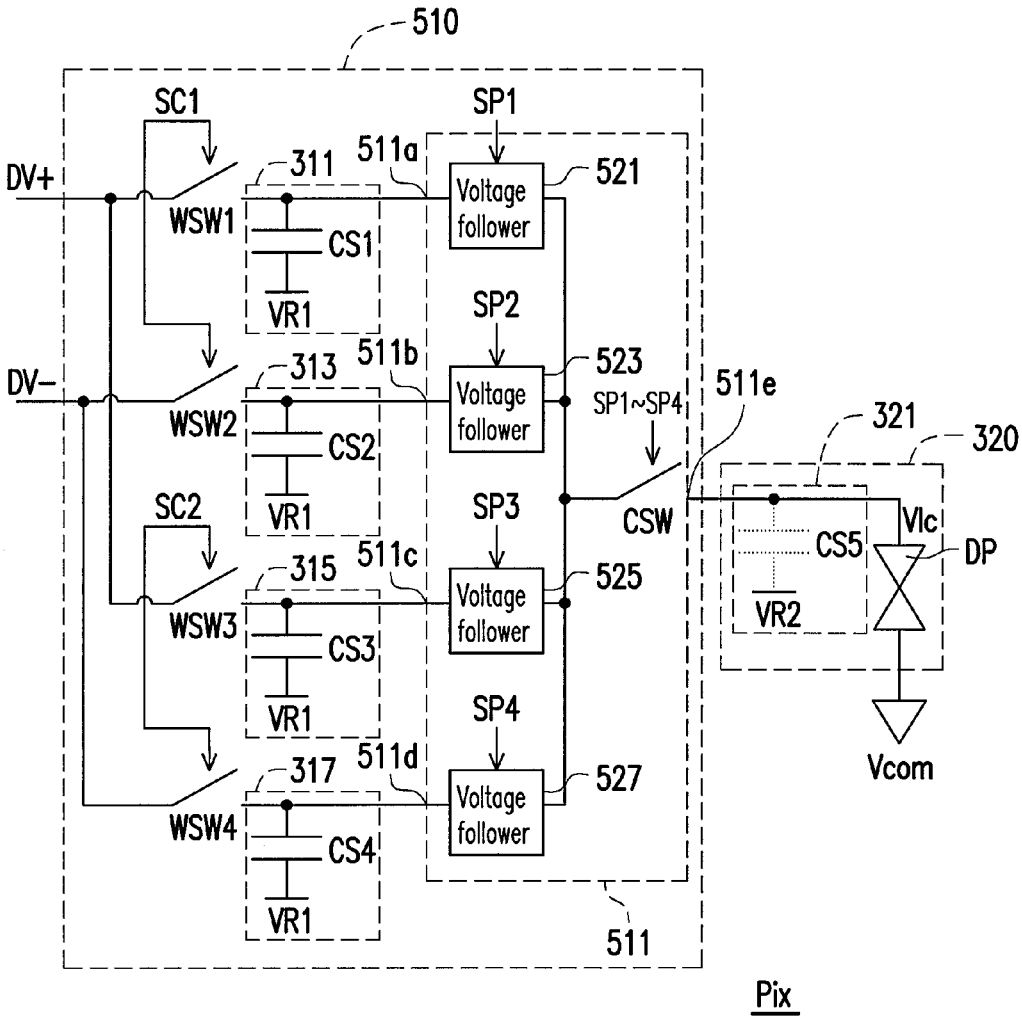
FIG. 5 is a circuit schematic diagram illustrating a pixel circuitry Pix of FIG. 2 according to a second embodiment of the invention.

FIG. 5 is a circuit schematic diagram illustrating the pixel circuitry Pix of FIG. 2 according to a second embodiment of the invention. Referring to FIG. 3A and FIG. 5, a circuit operation principle of the second embodiment is similar to that of the first embodiment of FIG. 3A, though a difference there between lies in a switching unit 511. In the present embodiment, the switching unit 511 includes a first voltage follower 521, a second voltage follower 523, a third voltage follower 525, a fourth voltage follower 527 and a conducting switch CSW. An input terminal of the first voltage follower 521 serves as a first input terminal 511*a* of the switching unit 511, and is coupled to the first memory unit 311. The first voltage follower 521 is controlled by the first display signal SP1. An input terminal of the second voltage follower 523 serves as a second input terminal 511*b* of the switching unit 511, and is coupled to the second memory unit 313. The second voltage follower 523 is controlled by the second display signal SP2.

An input terminal of the third voltage follower 525 serves as a third input terminal 511*c* of the switching unit 511, and is coupled to the third memory unit 315. The third voltage follower 525 is controlled by the third display signal SP3. An input terminal of the fourth voltage follower 527 serves as a fourth input terminal 511*d* of the switching unit 511, and is coupled to the fourth memory unit 317. The fourth voltage follower 527 is controlled by the fourth display signal SP4. A first end of the conducting switch CSW is coupled to output terminals of the first voltage follower 521, the second voltage follower 523, the third voltage follower 525 and the fourth voltage follower 527, and a second end of the conducting switch CSW serves as an output terminal 511*e* of the switching unit 511 and is coupled to the display unit 320. The conducting switch CSW is controlled by the first display signal SP1, the second display signal SP2, the third display signal SP3 and the fourth display signal SP4. Wherein, the voltage followers 521, 523, 525 and 527 can be implemented according to the circuit structure of the amplifiers 419 or 421, and detailed descriptions thereof are not repeated.

Further, in a circuit design, the voltage follower (for example, 521) is generally maintained in an operating state, though in an actual circuit application, besides the input terminal and the output terminal, the voltage follower may also have an enable pin or a power pin, and whether the voltage follower is operated is controlled by a voltage exerted to the enable pin or the power pin of the voltage follower. Namely, a display signal can be exerted to the enable pin or the power pin of the voltage follower to control the operating state of the voltage follower.

According to the above descriptions and FIG. 3B, the first voltage follower 521 is operated during the front half period FA2 of the frame period FP2, the second voltage follower 523 is operated during the back half period FB2 of the frame period FP2, the third voltage follower 525 is operated during the front half period FA1 of the frame period FP1 and the front half period FA3 of the frame period FP3, and the fourth voltage follower 527 is operated during the back half period FB1 of the frame period FP1 and the back half period FB3 of the frame period FP3.

Moreover, the voltage follower 521, 523, 525, 527 can block a current between the input terminal and the output terminal. In other words, for example, during the operation of the first voltage follower 521, a charge sharing effect between the first capacitor CS1 and the fifth capacitor CS5 and the liquid crystal capacitor DP can be avoided. Similarly, the second voltage follower 523, the third voltage follower 525, and the fourth voltage follower 527 also avoid a charge sharing effect as described above.

Figure 6:
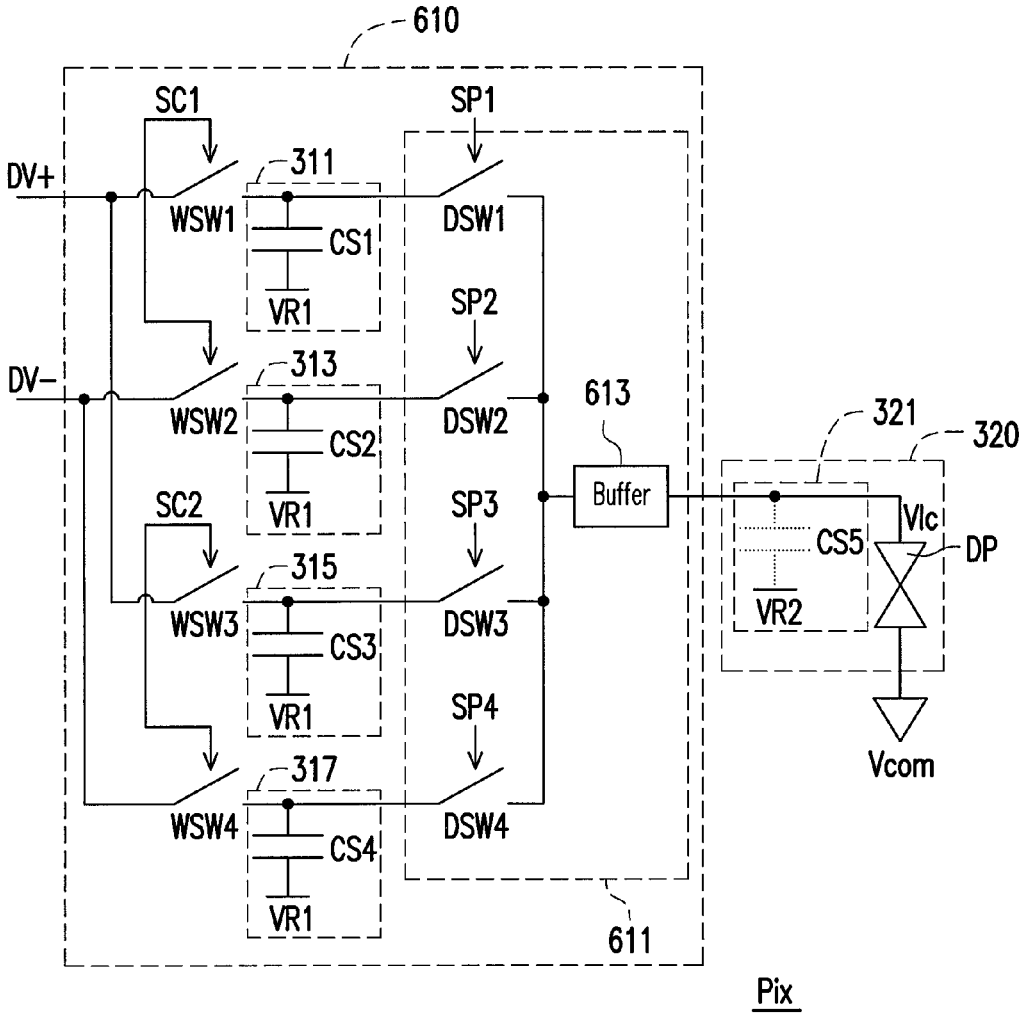
FIG. 6 is a circuit schematic diagram illustrating a pixel circuitry Pix of FIG. 2 according to a third embodiment of the invention.

FIG. 6 is a circuit schematic diagram illustrating the pixel circuitry Pix of FIG. 2 according to a third embodiment of the invention. Referring to FIG. 3A and FIG. 6, a circuit operation principle of the third embodiment is similar to that of the first embodiment of FIG. 3A, though a difference there between lies in a storage unit 610 of the third embodiment. A switching unit 611 of the storage unit 610 further includes a buffer 613. An input terminal of the buffer 613 is coupled to the second ends of the first display switch DSW1, the second display switch DSW2, the third display switch DSW3 and the fourth display switch DSW4, and an output terminal of the buffer 613 serves as an output terminal of the switching unit 611 and is coupled to the liquid crystal capacitor DP. Wherein, the buffer 613 can be implemented by a voltage follower, though the invention is not limited thereto. In this way, the charge sharing effect between the first capacitor CS1, the second capacitor CS2, the third capacitor CS3 or the fourth capacitor CS4 and the fifth capacitor CS5 and the liquid crystal capacitor D can be avoided.

Figure 7A:
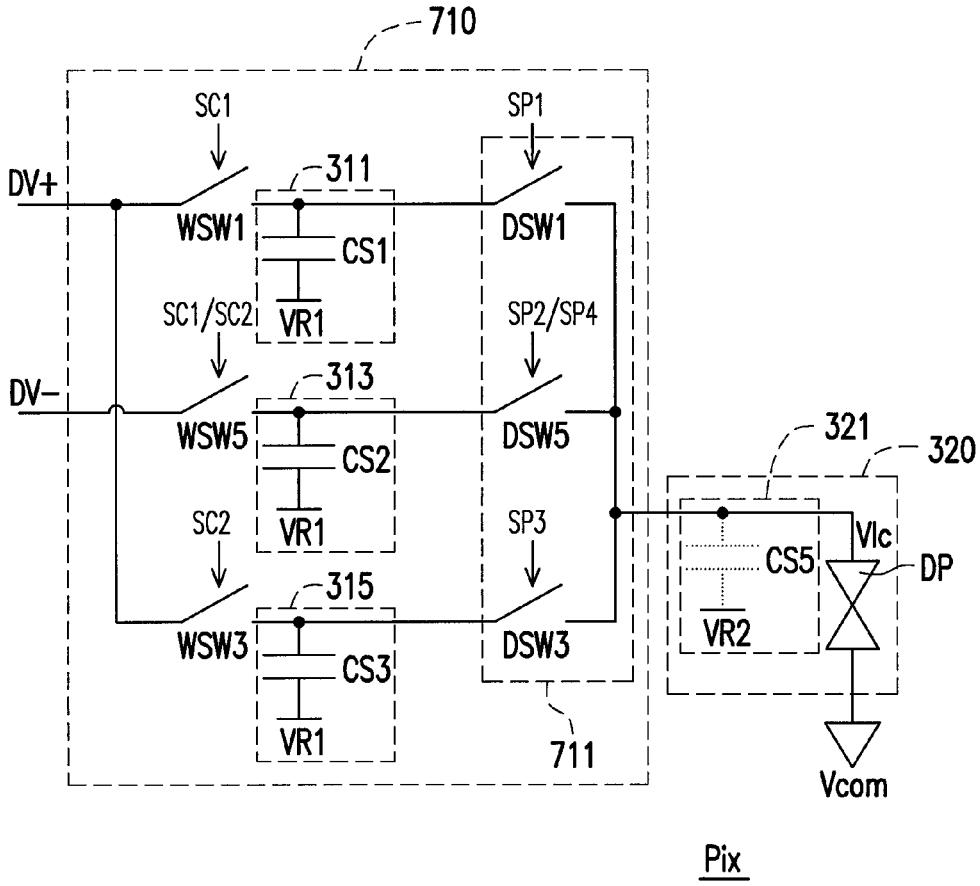
FIG. 7A is a circuit schematic diagram illustrating a pixel circuitry Pix of FIG. 2 according to a fourth embodiment of the invention.

FIG. 7A is a circuit schematic diagram illustrating the pixel circuitry Pix of FIG. 2 according to a fourth embodiment of the invention. Referring to FIG. 3A and FIG. 7A, a difference there between lies in a fifth writing switch WSW5 of a storage unit 710 and a fifth display switch DSW5 in a switching unit 711. Wherein, the fifth writing switch WSW5 can be regarded as a combination of the second writing switch WSW2 and the fourth writing switch WSW4, and the fifth display switch DSW5 can be regarded as a combination of the second display switch DSW2 and the fourth display switch DSW4.

Figure 7B:
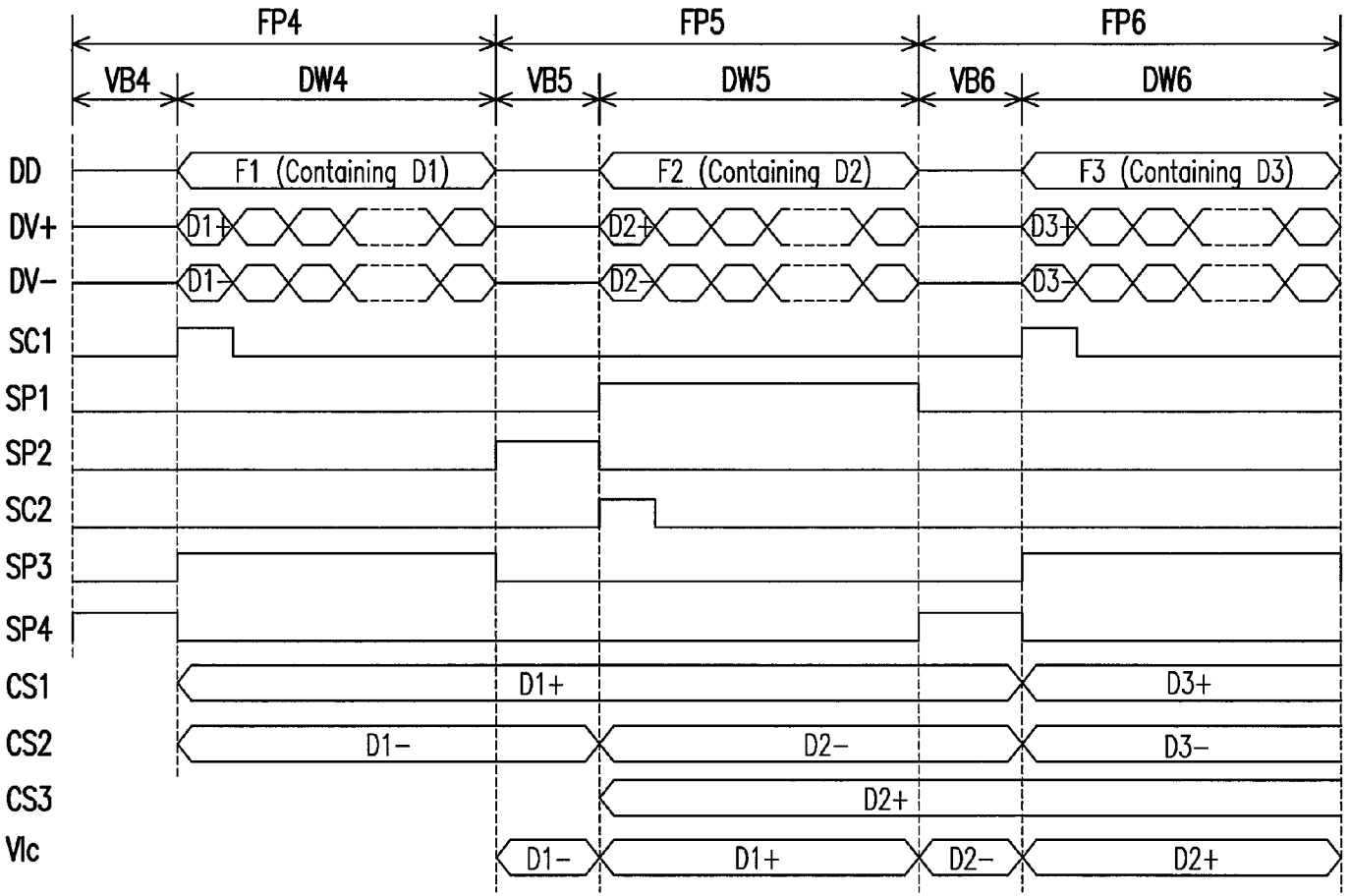
FIG. 7B is a driving timing diagram of a display 200 according to another embodiment of the invention.

FIG. 7B is a driving timing diagram of a display according to another embodiment of the invention. Referring to FIG. 2, FIG. 7A and FIG. 7B, in the present embodiment, each frame period (for example, FP4, FP5 or FP6) also includes a data writing period (for example, DW4, DW5 or DW6) and a vertical blanking period (for example, VB4, VB5 or VB6), and the vertical blanking period (for example, VB4, VB5 or VB6) of each frame period (for example, FP4, FP5 or FP6) is arranged in front of the data writing period (for example, DW4, DW5 or DW6). Driving waveforms of the first scan signal SC1, the second scan signal SC2, the data signal DD, the positive polarity data signal DV+ and the negative polarity data signal DV− during the frame period FP4, FP5 or FP6 are similar to that during the frame period FP1, FP2 or FP3, and therefore detailed descriptions thereof are not repeated.

During the data writing period DW4 of the frame period FP4, the first writing switch WSW1 and the fifth writing switch WSW5 are turned on according to the first scan signal SC1, so that the first capacitor CS1 receives and stores the positive polarity data voltage D1+ through the first writing switch WSW1, and the second capacitor CS2 receives and stores the negative polarity data voltage D1− through the fifth writing switch WSW5. Moreover, the third display signal SP3 is in the high level, and the first display signal SP1, the second display signal SP2 and the fourth display signal SP4 are in the low level. Now, the voltage stored by the third capacitor CS3 is transmitted to the liquid crystal capacitor DP and the fifth capacitor CS5 through the third display switch DSW3. Assuming the voltage stored by the third capacitor CS3 is not the data voltage used for displaying, so that a change of the pixel voltage Vlc is neglected.

During the vertical blanking period VB5 of the frame period FP5, the second display signal SP2 is in the high level, and the first display signal SP1, the third display signal SP3 and the fourth display signal SP4 are in the low level. Now, the negative polarity data voltage D1− stored by the second capacitor CS2 is transmitted to the liquid crystal capacitor DP and the fifth capacitor CS5 through the fifth display switch DSW5, so that the pixel voltage Vlc is approximately equal to the negative polarity data voltage D1−.

During the data writing period DW5 of the frame period FP5, the third writing switch WSW3 and the fifth writing switch WSW5 are in the turn-on state. The third capacitor CS3 receives and stores the positive polarity data voltage D2+ through the third writing switch WSW3, and the second capacitor CS2 receives and stores the negative polarity data voltage D2− through the fifth writing switch WSW5. Moreover, the first display signal SP1 is in the high level, and the second display signal SP2, the third display signal SP3 and the fourth display signal SP4 are in the low level. Now, the positive polarity data voltage D1+ stored by the first capacitor CS1 is transmitted to the liquid crystal capacitor DP and the fifth capacitor CS5 through the first display switch DSW1, so that the pixel voltage Vlc is approximately equal to the positive polarity data voltage D1+.

During the vertical blanking period VB6 of the frame period FP6, the fourth display signal SP4 is in the high level, and the first display signal SP1, the second display signal SP2 and the third display signal SP3 are in the low level. Now, the negative polarity data voltage D2− stored by the second capacitor CS2 is also transmitted to the liquid crystal capacitor DP and the fifth capacitor CS5 through the fifth display switch DSW5, so that the pixel voltage Vlc is approximately equal to the negative polarity data voltage D2−.

During the data writing period DW6 of the frame period FP6, the first capacitor CS1 receives and stores the positive polarity data voltage D3+ through the first writing switch WSW1, and the second capacitor CS2 receives and stores the negative polarity data voltage D3− through the fifth writing switch WSW5. Moreover, the positive polarity data voltage D2+ stored by the third capacitor CS3 is transmitted to the liquid crystal capacitor DP and the fifth capacitor CS5 through the third display switch DSW3, so that the pixel voltage Vlc is approximately equal to the positive polarity data voltage D2+.

According to the above descriptions, by controlling conducting stats of the first writing switch WSW1, the third writing switch WSW3, the fifth writing switch WSW5, the first display switch DSW1, the third display switch DSW3 and the fifth display switch DSW5, the first capacitor CS1 and the third capacitor CS3 can alternately store the positive polarity data voltages during different frame periods, and alternately output the stored positive polarity data voltages. The second capacitor CS2 stores the negative polarity data voltage of different frames, and outputs the stored negative polarity data voltage during the vertical blanking period.

Figure 8:
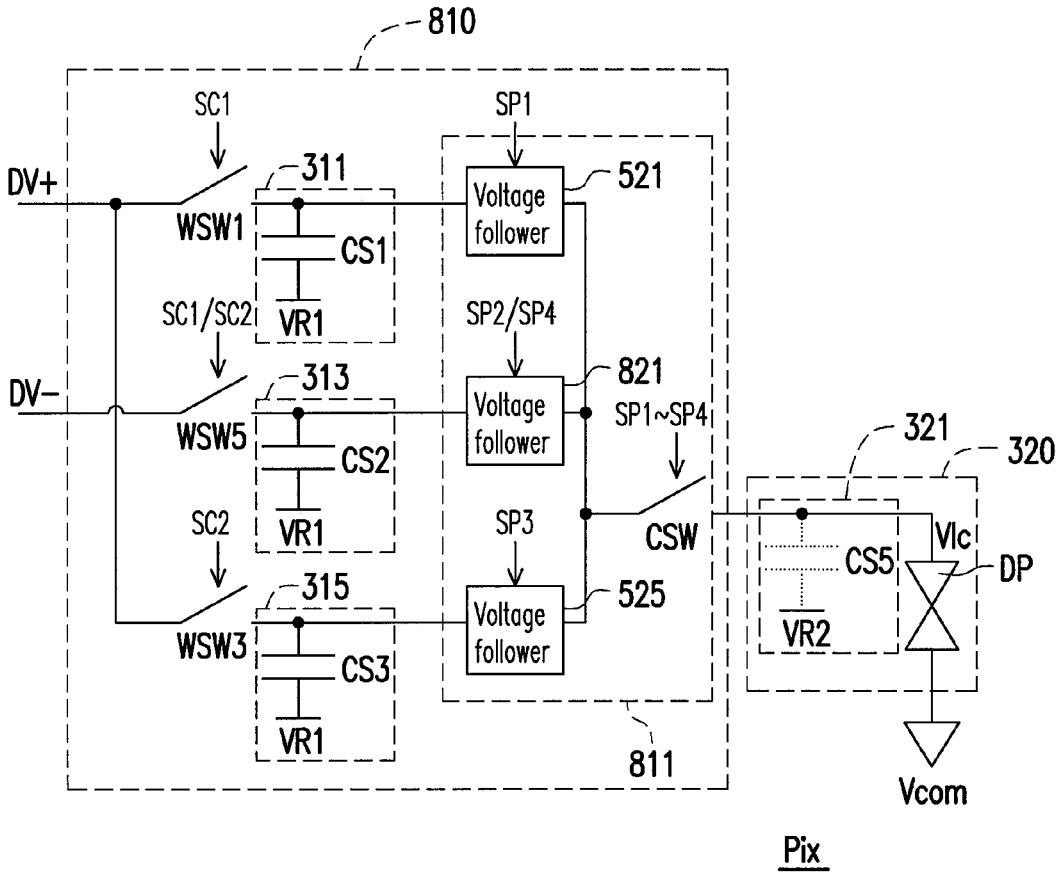
FIG. 8 is a circuit schematic diagram illustrating a pixel circuitry Pix of FIG. 2 according to a fifth embodiment of the invention.

FIG. 8 is a circuit schematic diagram illustrating the pixel circuitry Pix of FIG. 2 according to a fifth embodiment of the invention. Referring to FIG. 7A and FIG. 8, a circuit operation principle of the fifth embodiment is similar to that of the fourth embodiment of FIG. 7A, though a difference there between lies in a switching unit 811 of a storage unit 810. The switching unit 811 includes a first voltage follower 521, a third voltage follower 525, a fifth voltage follower 821 and a conducting switch CSW, wherein operations of the first voltage follower 521, the third voltage follower 525 and the conducting switch CSW are similar as that of the second embodiment, and therefore detailed descriptions thereof are not repeated. In the present embodiment, an input terminal of the fifth voltage follower 821 serves as a second input terminal of the switching unit 811 and is coupled to the second memory unit 313. The voltage follower 821 is controlled by the second display signal SP2 and the fourth display signal SP4, namely, the voltage follower 821 is operated during the vertical blanking periods VB5 and VB6 of FIG. 7B.

Figure 9:
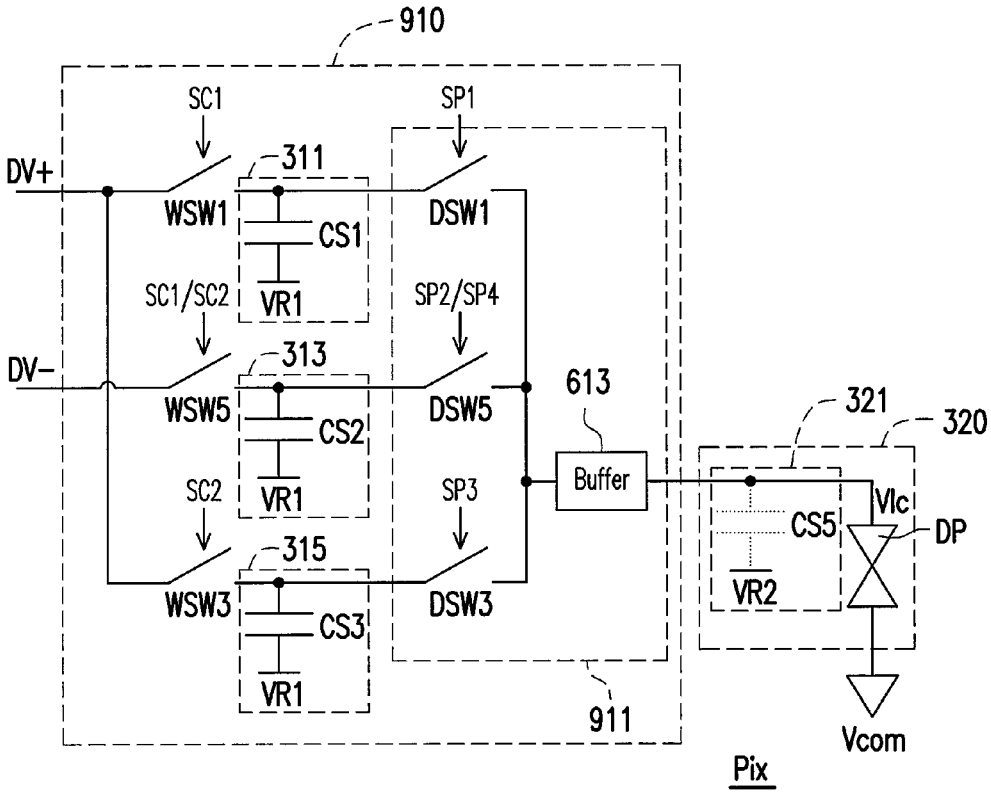
FIG. 9 is a circuit schematic diagram illustrating a pixel circuitry Pix of FIG. 2 according to a sixth embodiment of the invention.

FIG. 9 is a circuit schematic diagram illustrating the pixel circuitry Pix of FIG. 2 according to a sixth embodiment of the invention. Referring to FIG. 7A and FIG. 9, a circuit operation principle of the sixth embodiment is similar to that of the fourth embodiment of FIG. 7A, though a difference there between is that a switching unit 911 of the sixth embodiment further includes a buffer 613, wherein the operation of the buffer 613 is the same as that of the third embodiment, and therefore detailed description thereof is not repeated.

Figure 10:
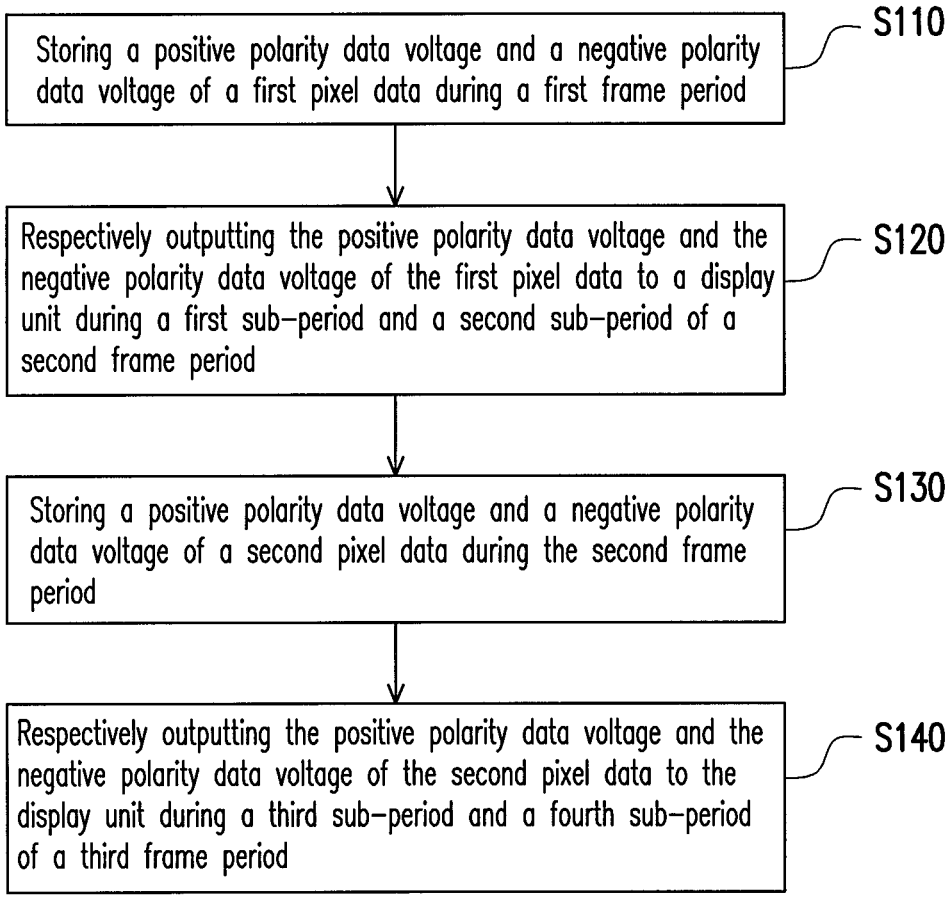
FIG. 10 is a flowchart illustrating an operating method of a pixel circuitry according to an embodiment of the invention.

According to the above embodiments, an operating method of the pixel circuitry is deduced. FIG. 10 is a flowchart illustrating an operating method of a pixel circuitry according to an embodiment of the invention. Referring to FIG. 10, a positive polarity data voltage and a negative polarity data voltage of a first pixel data are stored during a first frame period (step S110). During a first sub-period and a second sub-period of a second frame period, the positive polarity data voltage and the negative polarity data voltage of the first pixel data are respectively output to a display unit (step S120). During the second frame period, a positive polarity data voltage and a negative polarity data voltage of a second pixel data are stored (step S130). During a third sub-period and a fourth sub-period of a third frame period, the positive polarity data voltage and the negative polarity data voltage of the second pixel data are respectively output to the display unit (step S140). Wherein, the aforementioned descriptions can be referred for detailed steps of the operating method, and therefore detailed descriptions thereof are not repeated.

In summary, according to the display, the pixel circuitry and the operating method of the pixel circuitry of the invention, more than three capacitors are configured in the pixel circuitry, and by correspondingly controlling the writing switches and the switching unit, the capacitors respectively store the corresponding positive polarity data voltage and the negative polarity data voltage, and sequentially output the stored positive polarity data voltage and the negative polarity data voltage. In this way, the data transmission rate of the source driver can be reduced. Moreover, voltage followers can be configured in the switching unit of the pixel circuitry, so as to avoid occurrence of the charge sharing effect.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display, comprising:

a source driver, converting a plurality of first pixel data to a plurality of first polarity data voltages and a plurality of second polarity data voltages in order during a first frame period, and converting a plurality of second pixel data to a plurality of third polarity data voltages and a plurality of fourth polarity data voltages in order during a second frame period, wherein one of the first polarity data voltages and the corresponding second polarity data voltage are outputted simultaneously, and one of the third polarity data voltages and the corresponding fourth polarity data voltage are outputted simultaneously;

a gate driver, outputting a plurality of scan signals and a plurality of display signals;

a display panel; and a plurality of pixel circuitries, disposed on the display panel, coupled to the source driver, respectively storing the corresponding first polarity data voltage and the corresponding second polarity data voltage during the first frame period according to a first signal of the scan signals, respectively displaying the corresponding first polarity data voltage and the corresponding second polarity data voltage during a first sub-period and a second sub-period of the second frame period respectively according to the corresponding display signals, and respectively storing the corresponding third polarity data voltage and the corresponding fourth polarity data voltage during the second frame period according to a second signal of the scan signals different from the first signal, wherein the first signal is enabled when the source driver outputs the corresponding first polarity data voltage and the corresponding second polarity data voltage at the same time, and the second signal is enabled when the source driver outputs the corresponding third polarity data voltage and the corresponding fourth polarity data voltage at the same time, wherein a length of the first sub-period and the second sub-period is equal to a length of the second frame period.

2. The display as claimed in claim 1, wherein the pixel circuitries respectively comprises:

a display unit; and a storage unit, comprising:

a first writing switch, having a first end coupled to the source driver;

a first memory unit, coupled to a second end of the first writing switch;

a second writing switch, having a first end coupled to the source driver;

a second memory unit, coupled to a second end of the second writing switch;

a third writing switch, having a first end coupled to the source driver;

a third memory unit, coupled to a second end of the third writing switch; and a switching unit, having a first input terminal coupled to the first memory unit, a second input terminal coupled to the second memory unit, a third input terminal coupled to the third memory unit, and an output terminal coupled to the display unit.

3. The display as claimed in claim 2, wherein the first writing switch and the second writing switch are conducted during the first frame period, the first memory unit stores the first polarity data voltage through the conducted first writing switch, the second memory unit stores the second polarity data voltage through the conducted second writing switch, the second writing switch and the third writing switch are conducted during the second sub-period of the second frame period, the second memory unit stores the fourth polarity data voltage through the conducted second writing switch, the third memory unit stores the third polarity data voltage through the conducted third writing switch, the output terminal of the switching unit is coupled to the second input terminal of the switching unit during the first sub-period, the output terminal of the switching unit is coupled to the first input terminal of the switching unit during the second sub-period, the output terminal of the switching unit is coupled to the second input terminal of the switching unit during a third sub-period of a third frame period, and the output terminal of the switching unit is coupled to the third input terminal of the switching unit during a fourth sub-period of the third frame period.

4. The display as claimed in claim 3, wherein the switching unit comprises:

a first voltage follower, having an input terminal serving as the first input terminal of the switching unit, wherein the first voltage follower is operated during the second sub-period;

a second voltage follower, having an input terminal serving as the second input terminal of the switching unit, wherein the second voltage follower is operated during the first sub-period and the third sub-period;

a third voltage follower, having an input terminal serving as the third input terminal of the switching unit, wherein the third voltage follower is operated during the fourth sub-period; and a conducting switch, having an input terminal coupled to an output terminal of the first voltage follower, an output terminal of the second voltage follower and an output terminal of the third voltage follower, and an output terminal serving as the output terminal of the switching unit, wherein the conducting switch is conducted during the first sub-period, the second sub-period, the third sub-period and the fourth sub-period.

5. The display as claimed in claim 3, wherein the switching unit comprises:

a first display switch, having a first end serving as the first input terminal of the switching unit, and a second end coupled to the output terminal of the switching unit, wherein the first display switch is conducted during the second sub-period;

a second display switch, having a first end serving as the second input terminal of the switching unit, and a second end coupled to the output terminal of the switching unit, wherein the second display switch is conducted during the first sub-period and the third sub-period; and a third display switch, having a first end serving as the third input terminal of the switching unit, and a second end coupled to the output terminal of the switching unit, wherein the third display switch is conducted during the fourth sub-period.

6. The display as claimed in claim 5, wherein the switching unit further comprises:

a buffer, having an input terminal coupled to the second end of the first display switch, the second end of the second display switch and the second end of the third display switch, and an output terminal serving as the output terminal of the switching unit.

7. The display as claimed in claim 2, wherein the storage unit further comprises:

a fourth writing switch, having a first end coupled to the source driver; and a fourth memory unit, coupled to a second end of the fourth writing switch, wherein a fourth input terminal of the switching unit is coupled to the fourth memory unit.

8. The display as claimed in claim 7, wherein the first writing switch and the second writing switch are conducted during the first frame period, the first memory unit stores the first polarity data voltage through the conducted first writing switch, the second memory unit stores the second polarity data voltage through the conducted second writing switch, the third writing switch and the fourth writing switch are conducted during the second frame period, the third memory unit stores the third polarity data voltage through the conducted third writing switch, the fourth memory unit stores the fourth polarity data voltage through the conducted fourth writing switch, the output terminal of the switching unit is coupled to the first input terminal of the switching unit during the first sub-period, the output terminal of the switching unit is coupled to the second input terminal of the switching unit during the second sub-period, the output terminal of the switching unit is coupled to the third input terminal of the switching unit during a third sub-period of a third frame period, and the output terminal of the switching unit is coupled to the fourth input terminal of the switching unit during a fourth sub-period of the third frame period.

9. The display as claimed in claim 8, wherein the switching unit comprises:

a first voltage follower, having an input terminal serving as the first input terminal of the switching unit, wherein the first voltage follower is operated during the first sub-period;

a second voltage follower, having an input terminal serving as the second input terminal of the switching unit, wherein the second voltage follower is operated during the second sub-period;

a third voltage follower, having an input terminal serving as the third input terminal of the switching unit, wherein the third voltage follower is operated during the third sub-period;

a fourth voltage follower, having an input terminal serving as the fourth input terminal of the switching unit, wherein the fourth voltage follower is operated during the fourth sub-period; and a conducting switch, having an input terminal coupled to an output terminal of the first voltage follower, an output terminal of the second voltage follower, an output terminal of the third voltage follower and an output terminal of the fourth voltage follower, and an output terminal serving as the output terminal of the switching unit, wherein the conducting switch is conducted during the first sub-period, the second sub-period, the third sub-period and the fourth sub-period.

10. The display as claimed in claim 8, wherein the switching unit comprises:

a first display switch, having a first end serving as the first input terminal of the switching unit, and a second end coupled to the output terminal of the switching unit, wherein the first display switch is conducted during the first sub-period;

a second display switch, having a first end serving as the second input terminal of the switching unit, and a second end coupled to the output terminal of the switching unit, wherein the second display switch is conducted during the second sub-period;

a third display switch, having a first end serving as the third input terminal of the switching unit, and a second end coupled to the output terminal of the switching unit, wherein the third display switch is conducted during the third sub-period; and a fourth display switch, having a first end serving as the fourth input terminal of the switching unit, and a second end coupled to the output terminal of the switching unit, wherein the fourth display switch is conducted during the fourth sub-period.

11. The display as claimed in claim 10, wherein the switching unit further comprises:

a buffer, having an input terminal coupled to the second end of the first display switch, the second end of the second display switch, the second end of the third display switch and the second end of the fourth display switch, and an output terminal serving as the output terminal of the switching unit.

12. The display as claimed in claim 2, wherein the display unit further comprises a display memory unit coupled to the output terminal of the switching unit.

13. The display as claimed in claim 1, wherein the source driver comprises a data channel, and the data channel comprises:

a first data latch, for receiving the first pixel data during the first frame period, and receiving the second pixel data during the second frame period;

a second data latch, coupled to the first data latch;

a first digital-to-analog converter (DAC), coupled to the second data latch, for converting the corresponding first pixel data to the corresponding first polarity data voltage, and converting the corresponding second pixel data to the corresponding third polarity data voltage; and a second DAC, coupled to the second data latch, for converting the corresponding first pixel data to the corresponding second polarity data voltage, and converting the corresponding second pixel data to the corresponding fourth polarity data voltage.

14. A pixel circuitry of a display, comprising:

a display unit; and a storage unit, comprising:

a first writing switch, having a first end coupled to a source driver and controlled by a first scan signal provided by a gate driver;

a first memory unit, coupled to a second end of the first writing switch;

a second writing switch, having a first end coupled to the source driver controlled by the first scan signal provided by the gate driver;

a second memory unit, coupled to a second end of the second writing switch;

a third writing switch, having a first end coupled to the source driver and controlled by a second scan signal provided by the gate driver;

a third memory unit, coupled to a second end of the third writing switch; and a switching unit, having a first input terminal coupled to the first memory unit, a second input terminal coupled to the second memory unit, a third input terminal coupled to the third memory unit, an output terminal coupled to the display unit, and controlled by a plurality of display signals provided by the gate driver, wherein the output terminal of the switching unit is coupled to the second input terminal of the switching unit during a first sub-period of the second frame period, the output terminal of the switching unit is coupled to the first input terminal of the switching unit during a second sub-period of the second frame period, and the second writing switch and the third writing switch are conducted during the second sub-period, wherein the source driver outputs a plurality of first polarity data voltages and a plurality of second polarity data voltages in order during a first frame period, outputs a plurality of third polarity data voltages and a plurality of fourth polarity data voltages in order during a second frame period, and a length of the first sub-period and the second sub-period is equal to a length of the second frame period, wherein one of the first polarity data voltages and the corresponding second polarity data voltage are outputted simultaneously, one of the third polarity data voltages and the corresponding fourth polarity data voltage are outputted simultaneously, the first signal is enabled when the source driver outputs the corresponding first polarity data voltage and the corresponding second polarity data voltage at the same time, and the second signal is enabled when the source driver outputs the corresponding third polarity data voltage and the corresponding fourth polarity data voltage at the same time.

15. The pixel circuitry of the display as claimed in claim 14, wherein the first writing switch and the second writing switch are conducted during the first frame period, the first memory unit stores a first polarity data voltage of a first pixel data through the conducted first writing switch, the second memory unit stores a second polarity data voltage of the first pixel data through the conducted second writing switch, the second memory unit stores a fourth polarity data voltage of a second pixel data through the conducted second writing switch, the third memory unit stores a third polarity data voltage of the second pixel data through the conducted third writing switch, the output terminal of the switching unit is coupled to the second input terminal of the switching unit during a third sub-period of a third frame period, and the output terminal of the switching unit is coupled to the third input terminal of the switching unit during a fourth sub-period of the third frame period.

16. The pixel circuitry of the display as claimed in claim 14, wherein the storage unit further comprises:

a fourth writing switch, having a first end coupled to the source driver; and a fourth memory unit, coupled to a second end of the fourth writing switch, wherein a fourth input terminal of the switching unit is coupled to the fourth memory unit.

17. The pixel circuitry of the display as claimed in claim 16, wherein the first writing switch and the second writing switch are conducted during the first frame period, the first memory unit stores a first polarity data voltage of a first pixel data through the conducted first writing switch, the second memory unit stores a second polarity data voltage of the first pixel data through the conducted second writing switch, the third writing switch and the fourth writing switch are conducted during the second frame period, the third memory unit stores a third polarity data voltage of a second pixel data through the conducted third writing switch, the fourth memory unit stores a fourth polarity data voltage of the second pixel data through the conducted fourth writing switch, the output terminal of the switching unit is coupled to the third input terminal of the switching unit during a third sub-period of a third frame period, and the output terminal of the switching unit is coupled to the fourth input terminal of the switching unit during a fourth sub-period of the third frame period.

* * * * *